US011447979B2

(12) United States Patent
Taylor et al.

(10) Patent No.: US 11,447,979 B2
(45) Date of Patent: Sep. 20, 2022

(54) FOOT PULL

(71) Applicant: 5TH AXIS, INC., San Diego, CA (US)

(72) Inventors: Chris Taylor, Encinitas, CA (US); Stephen Grangetto, Encinitas, CA (US)

( * ) Notice: Subject to any disclaimer, the term of this patent is extended or adjusted under 35 U.S.C. 154(b) by 175 days.

(21) Appl. No.: 17/071,359

(22) Filed: Oct. 15, 2020

(65) Prior Publication Data

US 2021/0332614 A1 Oct. 28, 2021

Related U.S. Application Data

(60) Provisional application No. 63/022,470, filed on May 9, 2020, provisional application No. 63/015,614, filed on Apr. 26, 2020.

(51) Int. Cl.
*E05B 53/00* (2006.01)
*E05B 47/00* (2006.01)
*E05B 51/02* (2006.01)

(52) U.S. Cl.
CPC ..... *E05B 53/001* (2013.01); *E05B 47/0001* (2013.01); *E05B 51/02* (2013.01)

(58) Field of Classification Search
CPC .... E05B 53/001; E05B 47/0001; E05B 51/02; E05Y 2900/132
See application file for complete search history.

(56) References Cited

U.S. PATENT DOCUMENTS 1,337,384 A 4/1920 Allen
4,569,546 A 2/1986 Howard et al.
5,193,863 A * 3/1993 McBain ..... E05B 53/001 292/336.3
5,983,454 A 11/1999 Hartselle, III
6,967,580 B1 * 11/2005 Schulze ..... G08B 25/016 340/568.1
7,043,800 B2 5/2006 Moody
7,717,068 B2 * 5/2010 Wilson ..... A01K 15/02 16/412
7,772,512 B2 * 8/2010 Milo ..... H01H 13/14 200/341
8,707,622 B1 * 4/2014 Neustel, Jr. ..... E05F 13/02 49/263
8,720,116 B1 * 5/2014 Ahmad ..... E05B 17/2038 16/431
8,752,334 B1 * 6/2014 Vanduch ..... E05B 53/001 49/70

(Continued)

*Primary Examiner* — Mark A Williams
(74) *Attorney, Agent, or Firm* — Mark Wisnosky

(57) ABSTRACT

An improved foot pull for hands free opening of a door is described. The design provides a more ergonomic engagement of the user by providing an angled plate to engage their foot the plate further including a region treated to prevent slippage of the users foot off of the plate. A pair of the foot pulls can be used in tandem to provide a door stop and a means to hold a door in the open position against a wall. The design can also include actuators that can release a latch on the door. The actuators include mechanical linkages to the door handle. The actuators can also be electronic with wired or wireless connection to the latch on the door and can further be used to signal and actuate any electronic device such as a light or alarm system. The door pull can also include a mechanical cable or a hydraulic connection to actuate the door latch.

6 Claims, 19 Drawing Sheets

(56) References Cited

U.S. PATENT DOCUMENTS

| | | | | |
|---|---|---|---|---|
| 9,115,530 | B2 | 8/2015 | Michael et al. | |
| 9,145,713 | B1 * | 9/2015 | Norris | E05B 53/00 |
| 9,714,524 | B2 * | 7/2017 | Parish-Allaire | E05B 53/001 |
| 9,822,572 | B2 | 11/2017 | Brown | |
| 10,156,085 | B2 * | 12/2018 | Standley | B21D 28/10 |
| 2005/0005402 | A1 * | 1/2005 | Moody | E05B 53/001 16/413 |
| 2009/0145037 | A1 * | 6/2009 | Michael | E05C 17/50 49/359 |
| 2013/0118085 | A1 * | 5/2013 | Hedemark | F16H 21/44 49/504 |
| 2015/0020454 | A1 * | 1/2015 | Klein | E05C 17/56 49/267 |
| 2015/0027060 | A1 * | 1/2015 | Sousa | E05C 19/006 49/394 |
| 2019/0128022 | A1 * | 5/2019 | Markway | E05B 17/22 |
| 2019/0338571 | A1 * | 11/2019 | Hughes | E05C 17/54 |
| 2020/0071962 | A1 * | 3/2020 | Markway | E05B 1/0046 |
| 2021/0310272 | A1 * | 10/2021 | Chu | E05B 1/0053 |
| 2021/0388634 | A1 * | 12/2021 | Wangley | E05B 63/22 |
| 2022/0018154 | A1 * | 1/2022 | Madden | E05F 11/54 |
| 2022/0154489 | A1 * | 5/2022 | Connell | E05B 53/001 |
| 2022/0154494 | A1 * | 5/2022 | Caines | E05B 53/001 |

* cited by examiner

100

FOOT PULL

CROSS-REFERENCE TO RELATED APPLICATIONS

This application claims priority to U.S. Provisional Applications 63/015,614 titled: FOOT PULL, filed 26 Apr. 2020 and to U.S. Provisional Application 63/022,470, titled FOOT PULL, filed 9 May 2020, both by the same inventors.

STATEMENT REGARDING FEDERALLY SPONSORED RESEARCH OR DEVELOPMENT

Not Applicable.

BACKGROUND OF THE INVENTION

Technical Field

The present invention relates to a foot pull that enables handsfree opening and closing of a hinged door.

Related Background Art

There are many situations where it is important to be able to open and close a door without using one's hands. Examples are places where maintaining sanitary conditions is important, such as operating rooms, kitchens and laboratories. In many cases to provide handsfree opening and closing the door is a swinging door such that it is opened with a push of the foot and swings closed. There are however many situations where for sanitary or any other reason a foot actuated device attached to the door provides a better solution. This is especially true of existing doors where there is a need for retrofitting the door to provide hands free access without having to replace one or in that case of some office and manufacturing situations many doors.

Designs for foot pulls and actuators for doors exist. Michael et al in U.S. Pat. No. 9,115,530, Moody in U.S. Pat. No. 7,043,800 and Brown in U.S. Pat. No. 9,822,572 all describe foot actuated door pulls. All have deficiencies in ergonomics, design and ability to be used in both a "manual" and an automated opening of a door. Improvements are needed. The present invention is a new design for a door foot pull that has an improved ergonomic design that provides a mechanical advantage not demonstrated by prior art door pulls. The design allows for a retrofit of existing doors, thereby adding a foot actuator but at the same time maintaining the ability to actuate the door latch using one's hands without the need to disengage the foot actuator. Additionally, the invented door pull can be modified for particular use through variation in a friction area or friction pad attached to the contact surface. Two of the door pulls can be used in tandem to provide both a door pull and a door stop, including latching means to hold a door in the open position. The same ergonomic design can be used with sensors and actuators to make a partial or fully automated door opening system that is still hands free.

BRIEF DESCRIPTION OF THE DRAWINGS

Features are numbered equivalently through all drawings.

DETAILED DESCRIPTION OF THE INVENTION

Figure 1:
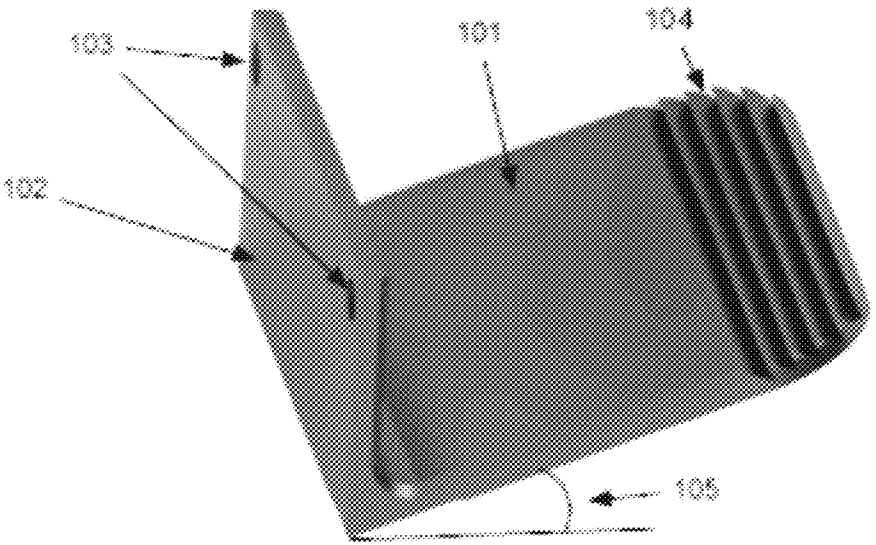
FIG. 1 shows a version of a preferred embodiment of the foot pull.

Referring to FIG. 1, the foot pull 100 is comprised of an angled piece of material having a vertical plate 102 and a second plate 101 projecting horizontally out from the first plate 102 at an angle 105 from a perpendicular projection. In the preferred embodiment the foot pull is made from aluminum or steel. Other material, such as plastic can also be used depending upon the force required to open the door attached to the foot pull. In the preferred embodiment the angle 105 is 20 degrees. The foot pull further includes a region 104 on the horizontal plate 101 at the end distal from the junction with the vertical plate that is treated to improve traction of a shoe bottom engaging the foot pull. Here, in the preferred embodiment the region 104 is serrated. In other embodiments the region 104 may include stair tread tape as is known in the art. In other embodiments the region 104 includes sand filled paint or etching or sand blasting to roughen the surface. The vertical plate 102 further includes at least one hole (here two are shown) 103 through which a screw may be threaded to attach the foot pull to a surface.

Figure 3:
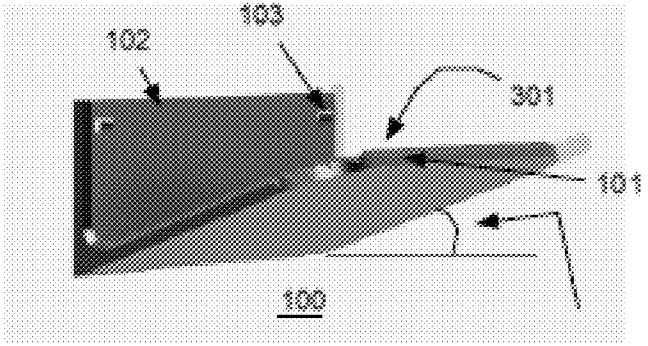
FIG. 3 shows details of the foot pull of FIG. 2.
Figure 2:
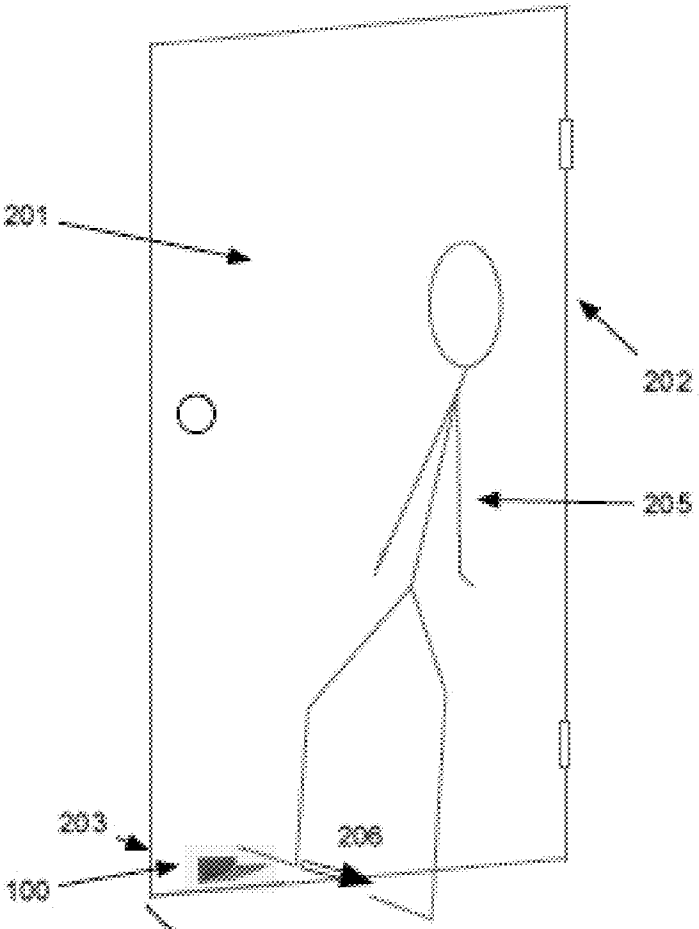
FIG. 2 shows the foot pull of FIG. 1 as attached to a door and used.

FIG. 2 shows the foot pull 100 as it would be attached to a door 201. FIG. 3 shows details of the foot pull with the same visual orientation as in FIG. 2. The vertical section 102 of the foot pull is attached to the door at the at the lower outer edge 203 of the door opposite the hinged edge 202 using screws threaded through attachment holes 103. The user of the door 205 engages their foot on the top surface 301 of the horizontally angled plate 101 and pulls their heel in the direction 206 thereby causing the door to swing in the direction 206 towards the user 205. The angle 105 of the plate 101 and the serrations on the top face 301 (seen in earlier figures) result in a firm, slip-free grip of the users 205 foot on the top of the plate 301.

Figure 4:
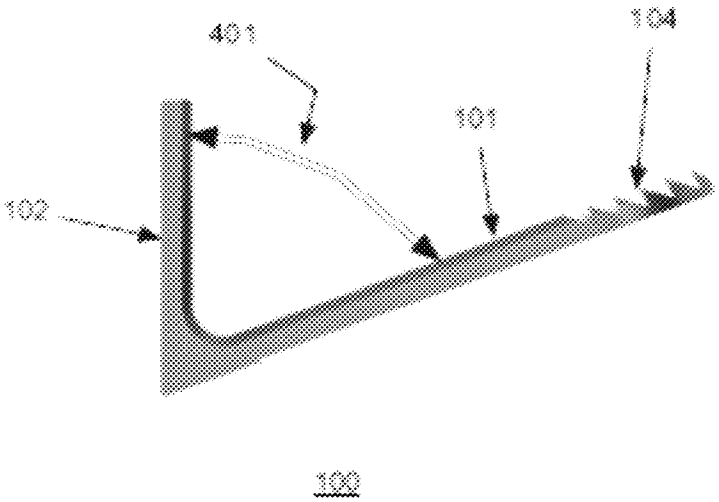
FIG. 4 shows a side view of the foot pull of FIG. 1.

FIG. 4 shows a side view of the foot pull 100 the parts are the same as previously described. The angle 401 in the preferred embodiment is 70 degrees. This is the complementary angle of that shown as 20 degrees in the previous figures.

Figure 5:
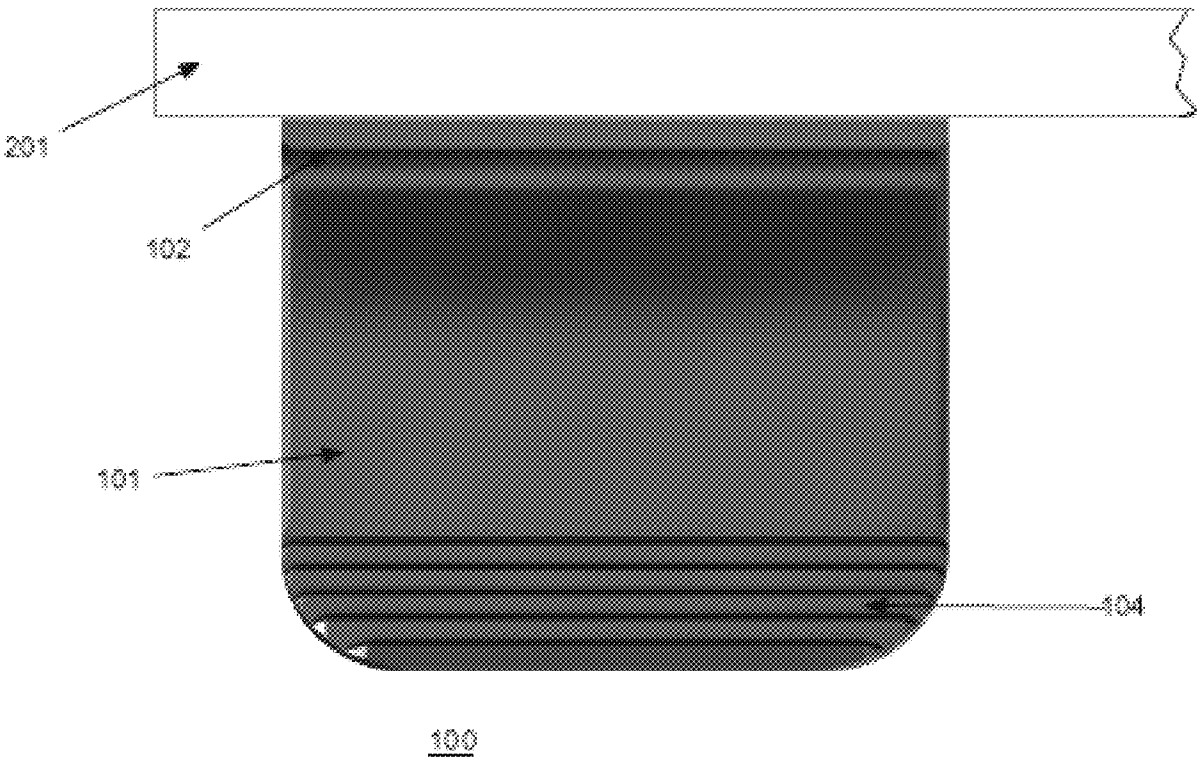
FIG. 5 shows a top view of the foot pull of FIG. 1 as attached to a door.

FIG. 5 shows a top view of the foot pull 100 as attached to a door 201 partially shown.

Figure 6:
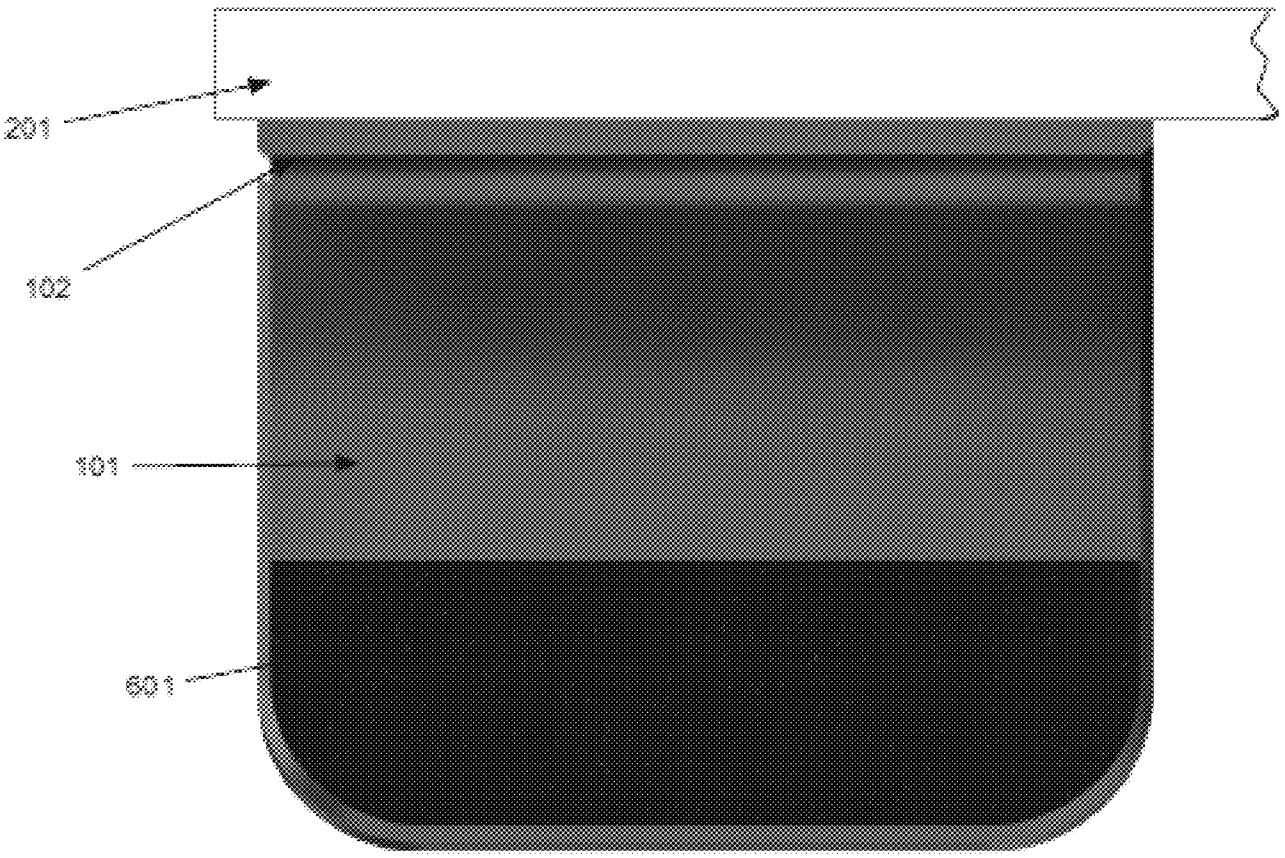
FIG. 6 shows a top view of an alternate embodiment of a foot pull.

FIG. 6 shows an alternate embodiment of a foot pull where the serration on the plate 101 seen in previous embodiments is replaced with a friction tape 601 such as is used to prevent slips on stair treads.

The preferred embodiment is a foot pull 100 for hands free opening or closing of a door, the foot pull comprising:

A first vertical rectangular plate 102 for attaching the foot pull to the door, and, a second nearly horizontal plate 101 that is angled 105 upward from horizontal, and, attached along a first edge to the vertical rectangular plate, and, a region 104 along a second edge of the nearly horizontal plate 101, the second edge opposite the first edge of the nearly horizontal plate where the region is treated to improve traction of a user of the foot pull, where the user 205 engages the foot pull 100 by placing their foot atop the nearly horizontal plate in the region treated for improved traction and pulling on the foot pull by moving their foot in a direction 206 such that the door moves in the direction 204 they move their foot thereby moving the door in either an opening or closing direction without using their hands.

Figure 7:
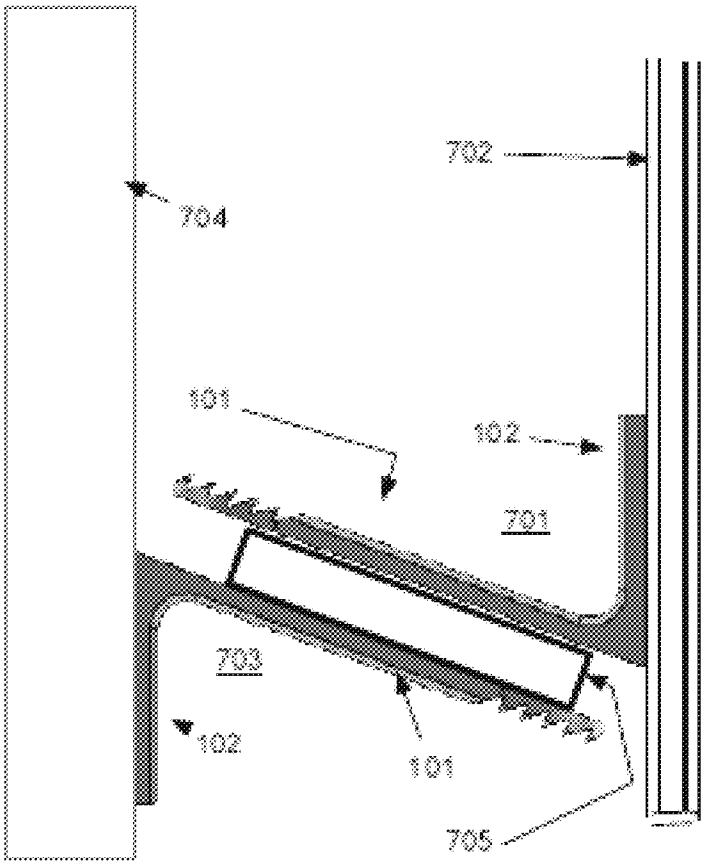
FIG. 7 shows use of a pair of the foot pulls in tandem to provide a door stop functionality as well as door pull functionality.

FIG. 7 shows an additional use enabled by the symmetric design of the foot pull. A first foot pull 701 is attached to the bottom outer edge of a door 702 using the plate 102 as previously described. A second identical foot pull 703 is inverted and attached to the wall again using the plate 102. The second plate 703 is positioned on a wall overlapping the first plate 701 such that the bottom sides of the plate 101 overlap as the door would be positioned if swung wide open. The combination of the two plates acts as a door stop as the bottom sides of the angled plates engage. In another embodiment an engagement means 705 is attached to the bottom plate 101 of the inverted foot pull 703 that is attached to the wall or the plate of the top foot pull 701 attached to the door or both. In one embodiment the engagement means is a magnet and the foot pulls are made of magnetic materials such as a ferro magnetic material. In another embodiment the engagement means are magnets, glued to the bottom side of each foot pull 701, 703. In another embodiment the engagement means is mechanical. In one embodiment the engagement means is hook and loop material as is known to be sold under the Velcro® brand.

Figure 8:
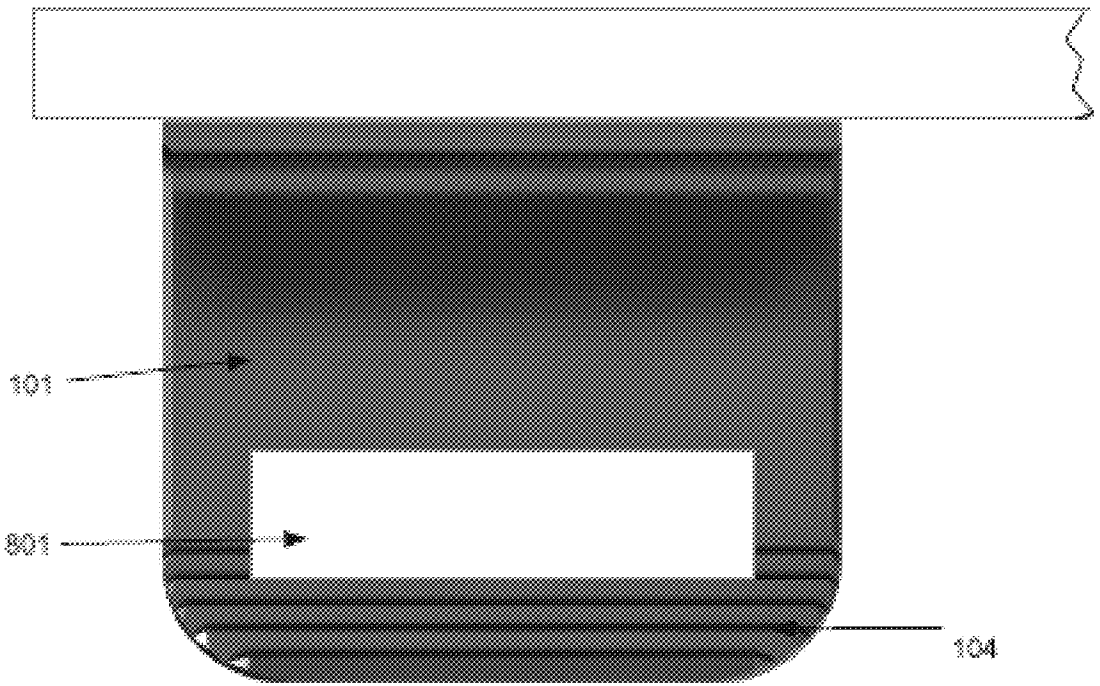
FIG. 8 shows an embodiment of the foot pull further including a sensor.

FIG. 8 shows an embodiment of the foot pull 100 that further includes a sensor and electronics such that when the door pull is engaged the electronics send a signal to an actuator device causing a latch on the door to release. The sensor can be a microswitch or a strain gauge. The electronics may simply be a switch connected to wires that connect to the door latch and the door latch includes all electronics to unlatch the door when the foot pull is engaged. In another embodiment the switch and electronics actuate a light or building alarm system. In another embodiment the electronics includes a switch and a wireless radio device that signals the door latch, the light and the alarm system.

Figure 10:
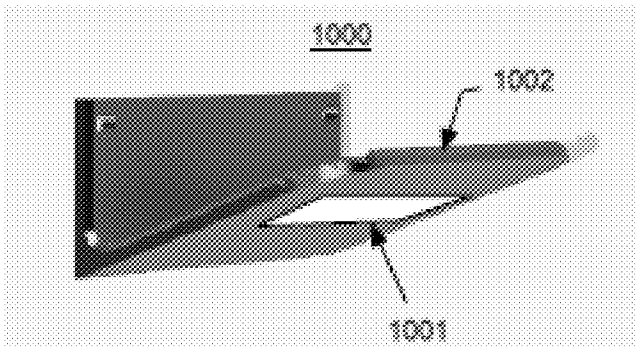
FIG. 10 shows a detail view of the foot pull of FIG. 9.
Figure 9:
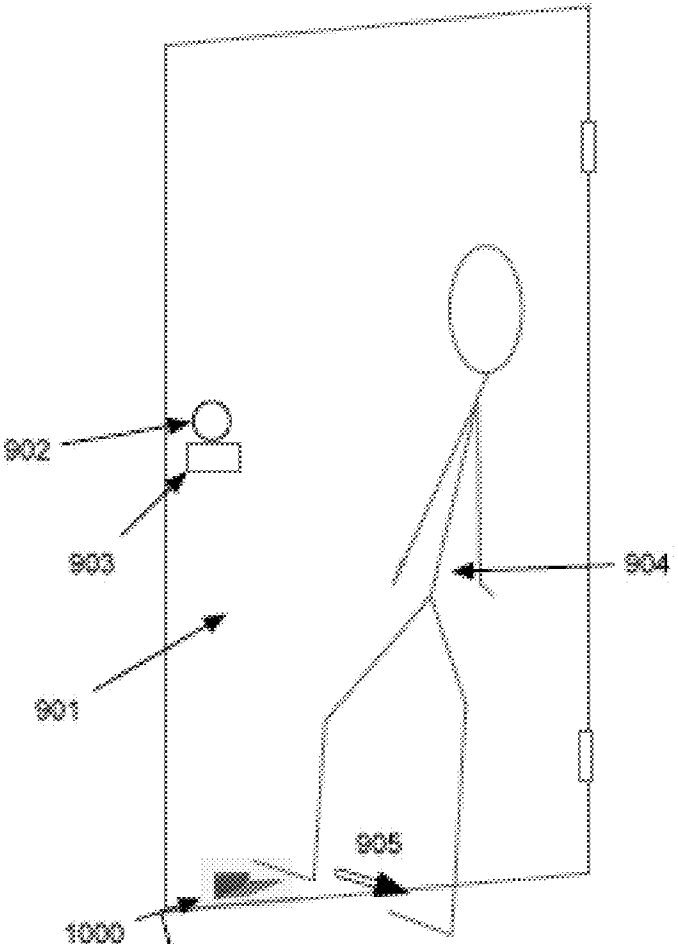
FIG. 9 shows a foot pull including a sensor as attached to a door.

FIG. 9 shows an embodiment of a door pull further including a sensor and electronics as attached to a door. FIG. 10 shows a closer view of the foot pull of FIG. 9. When the user 904 engages the foot pull 1000, the sensor 1001 is activated and transmits a radio signal to the actuator 903 attached to the door 901 at the latch 902. The actuator 903 release the latch 902 upon receiving a signal from the sensor and electronics 1001. Once the latch is released the user 904 pulls the foot engaging the foot pull towards 905 them and the door swings open along the arc 906. Note in this embodiment the sensor and radio transmitter electronics 1000 extend through the angled horizontal plate 1002 of the foot pull 1000.

Figure 12:
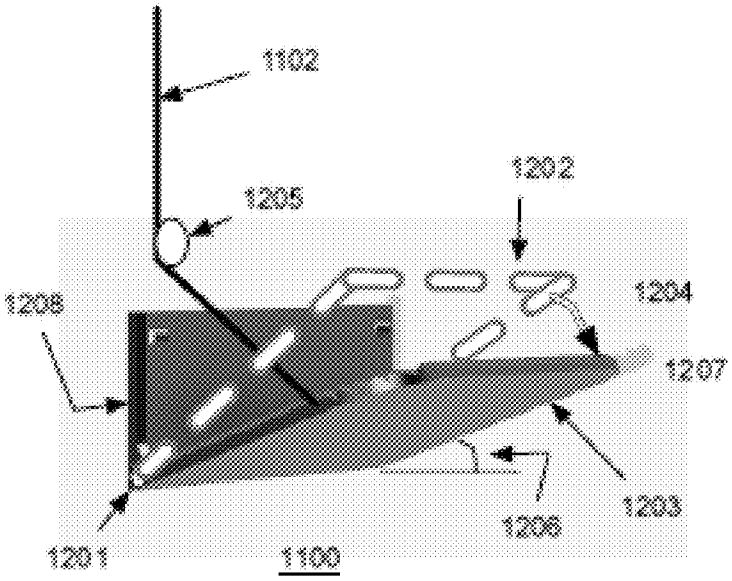
FIG. 12 shows a detail view of the foot pull of FIG. 11.
Figure 11:
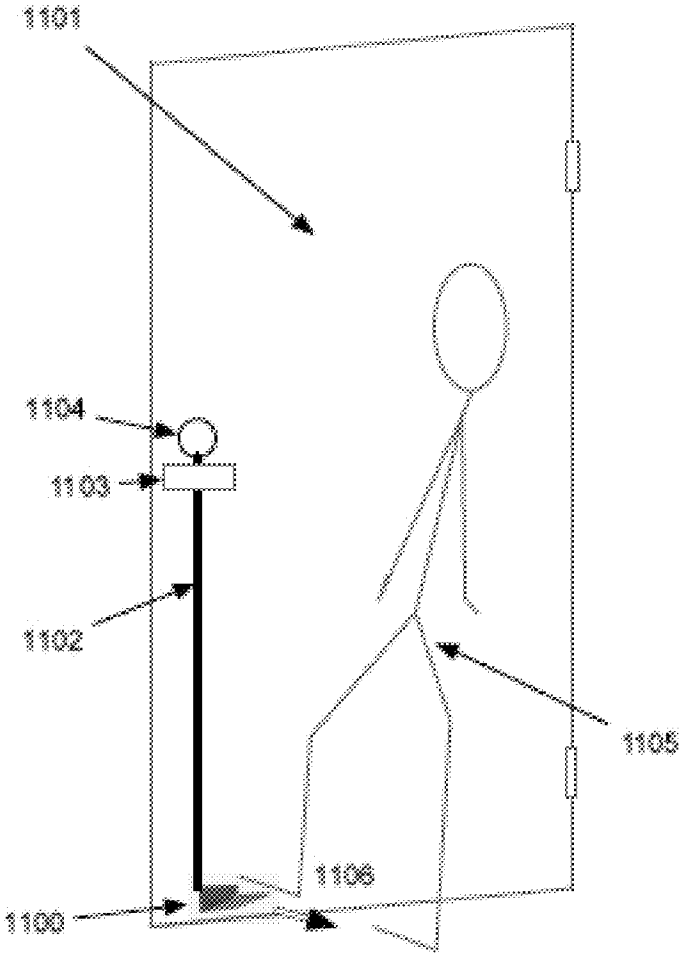
FIG. 11 shows a foot pull with a linkage to an actuator for the door latch.
Figure 13C:
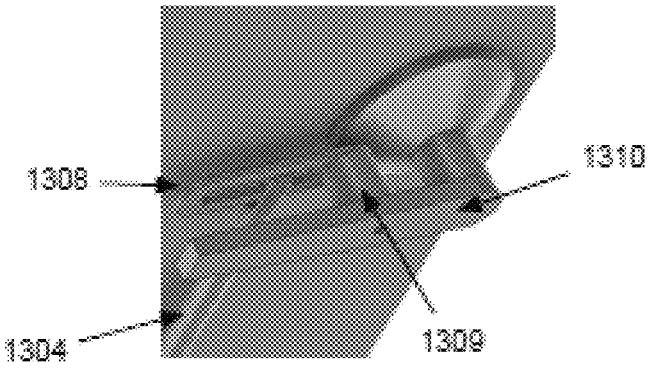
FIGS. 13A-13E show an embodiment of a foot pull including a hinged foot pull and a bar linkage.
Figure 13B:
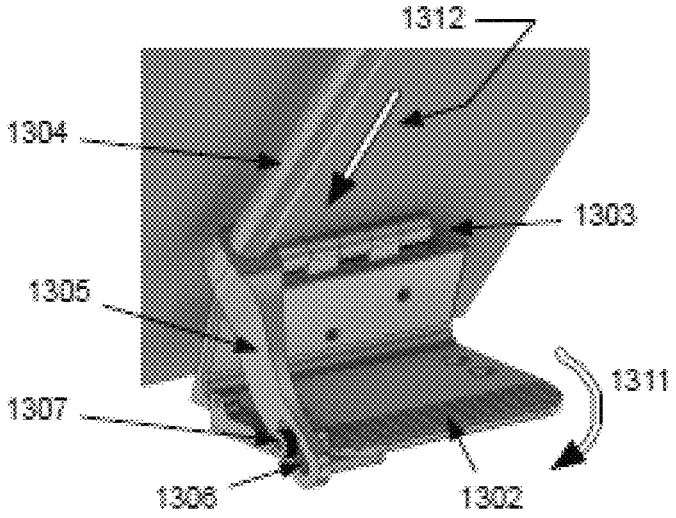
Figure 13A:
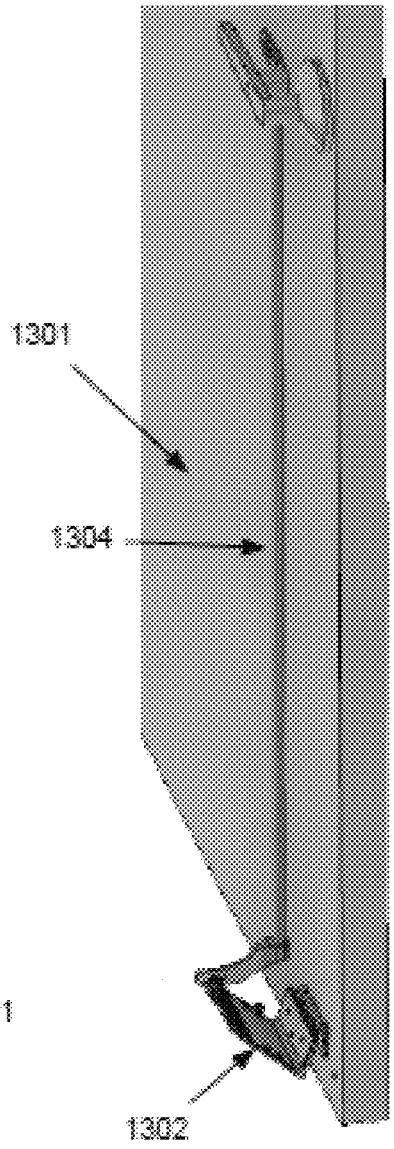
Figure 13E:
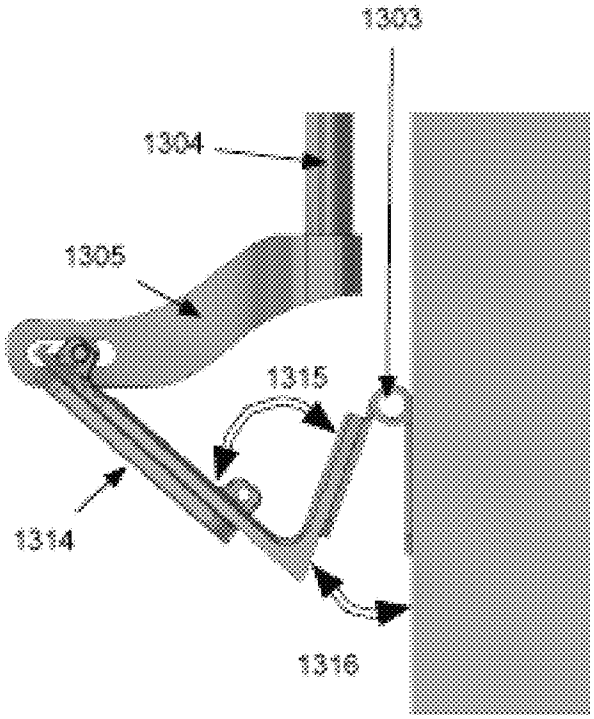
Figure 13D:
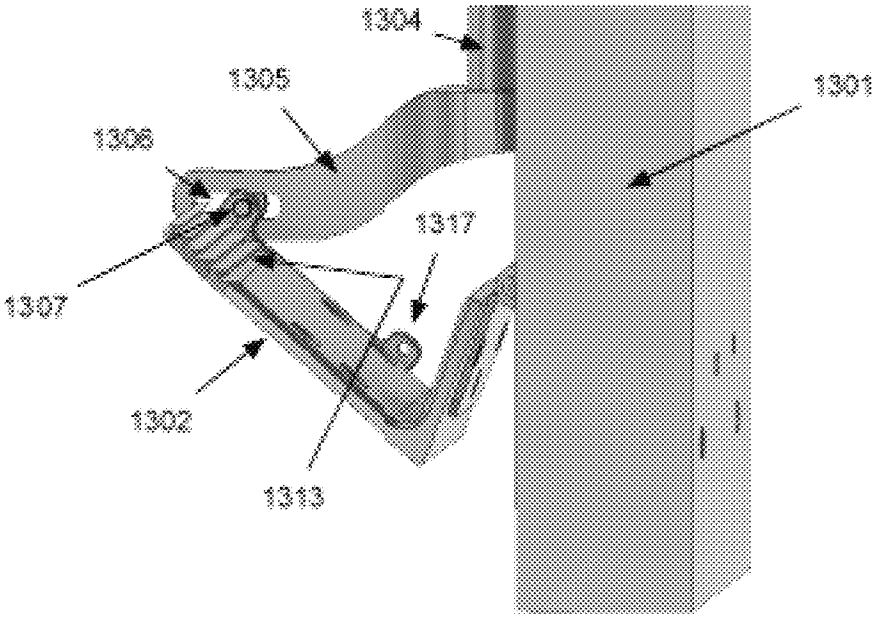

In another embodiment, shown in FIGS. 11 and 12, the linkage and means of actuating the latch between the foot pull 1100 and the actuator 1103 on the door latch 1104 is mechanical or hydraulic. The foot pull 1100 is actuated by the user 1105 by engaging the top surface of the foot pull with their foot. In this case the foot pull angled horizontal plate 1203 is attached to the vertical plate 1208 using a hinge 1201 such that when disengaged the plate 1203 is in a first position 1202 depicted by the dashed lines. When engaged by the user the angled horizontal plate moves through the angle 1204 to the previously described position 1207 where the angled plate 1203 is at a preferred angle 1206 of 20 degrees elevated from the horizontal. The movement through the arc 1204 causes, in one embodiment, the plate 1203 to pull on a cable 1102 routed, here using a guide or pulley 1205 and the cable actuates the door latch actuator 1103 and thereby releasing the latch 1104 such that as the user 1105 moves their foot as already described, the door 1101 is opened.

In another embodiment the connection 1102 is tubing containing a hydraulic fluid, and, the foot pull further includes a hydraulic cylinder (not shown) attached to the plate 1203 such that when the plate 1203 is moved through the arc 1204 the hydraulic fluid in the line 1102 is compressed, thereby actuating actuator 1103 and releasing the latch 1104 thereby allowing user to further move their foot in the direction 1106 and open the door.

FIG. 13 shows a foot pull with a mechanical link to the door handle such that stepping down upon and pulling with one's foot the door is unlatched through the door handle and can then be pulled open by the user with their foot. The action by the user is the same as already described in FIGS. 9 and 11. The embodiment includes a foot pull 1302 with the same geometry as that described in FIG. 1 that is attached using a hinge 1303 to the bottom surface of the door 1301. Upon stepping on the foot pull 1302 the foot pull moves in a downward direction 1311. The foot pull 1302 is connected through a slotted arm 1305 to an actuator rod 1304 that extends upward along the face of the door 1301 to a second slotted actuator 1308 that is connected using connector 1309 to the door handle 1310. Stepping on the foot pull 1302 and thereby moving it in the direction 1311 causes the connecting rod 1304 to move downward 1312 and thereby pulling the door handle 1310 downward and unlatching the door to allow its opening. The foot pull 1302 is attached to the slotted arm 1305 by a pin 1307 fixed to an outer edge of the foot pull 1302 that fits through the slot 1306. The pin 1307 is sized o slide within the slot 1306 and when it engages a distal end of the slot pulls the connected rod 1304 downward. 1312. Upon release of the foot pull 1302 the door handle 1310 returns to its normal, latched, position and the door swings shut and is latched. Further detailed views of the foot pull and actuator are shown in FIGS. 13D and 13E. The pin 1307 that fits into the slot 1306 is held to the foot pull 1302 by use of a plate 1314 that is fitted to the bottom of the foot pull 1302. The pin 1307 is fitted into a tab on the plate extending perpendicular from the plane of the plate 1314. A second tab 1317 is fitted similarly to the plate 1314 and could be used instead of the tab shown including pin 1307 where a lesser length of travel of the bracket 1305 and rod 1304 is desired. The foot pull is seen to be the same as that described in FIG. 1 where the angle 1315 has the preferred angle of. 70 degrees. When the foot pull 1302 is pushed downward by the user's foot, the foot pull pivots through the angle 1316 until hinge 1303 is fully closed.

Figure 14B:
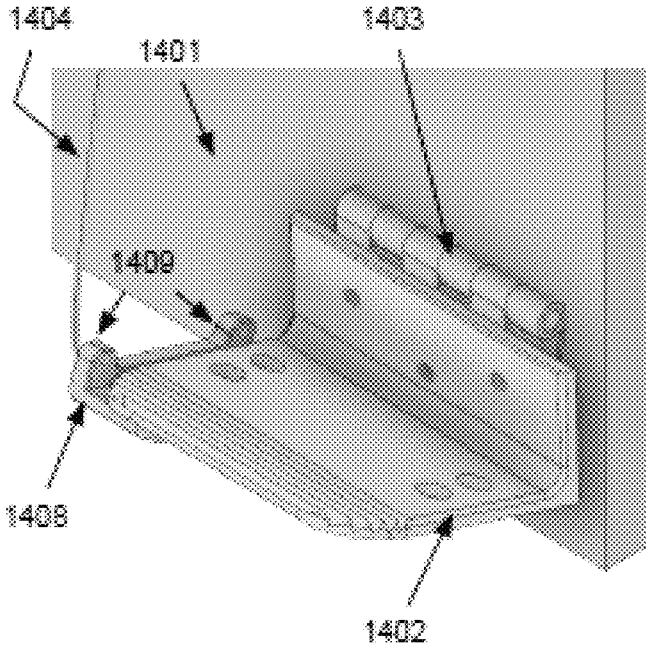
FIGS. 14A-14B show an embodiment of a foot pull including a hinged foot pull and cable linkage.
Figure 14A:
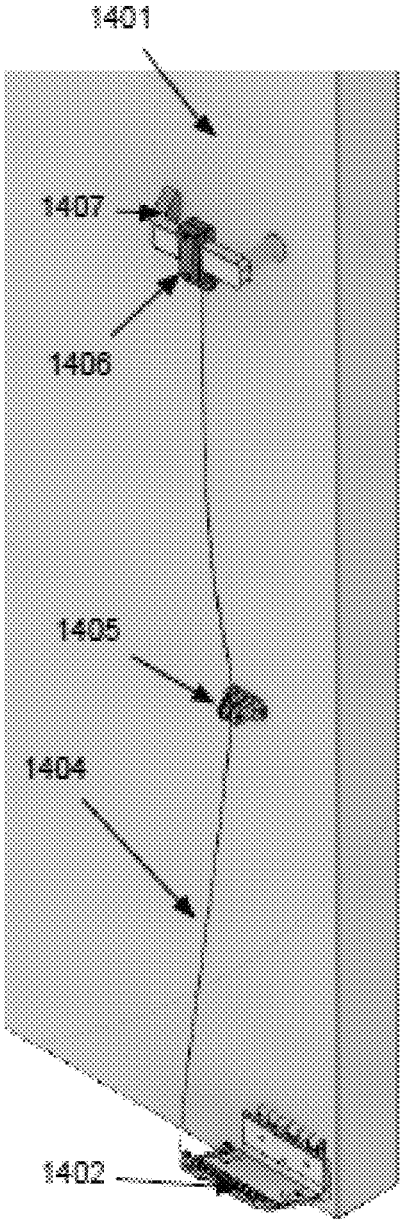

In another embodiment shown in FIGS. 14A and 14B, the same foot pull design 1402 is, similarly to the previous embodiment, attached to the door 1401 using a hinge 1403. A bracket 1408 that is planar and attaches to the bottom of the foot pull 1402 includes tabs 1409 that are perpendicular to the plane of the bracket 1408. A cable 1404 is attached to one of the tabs 1409 and is threaded through a guide 1405 and connects to a clamping bracket 1406 that clamps onto the door latch lever 1407 such that when a user presses down upon the foot pull 1402, tension is applied to the cable 1404 thereby pulling the door latch lever downward, releasing the latch, and, opening the door with a pull of the user's foot upon the foot pull 1402.

Figure 15C:
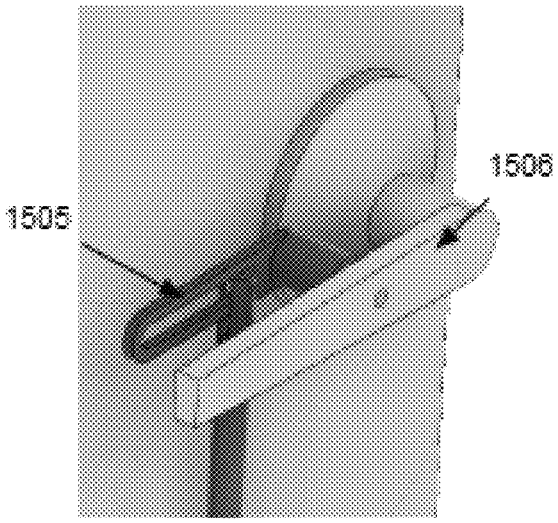
FIGS. 15A-15C show an embodiment of a foot pull including a sliding foot pull and a bar linkage.
Figure 15B:
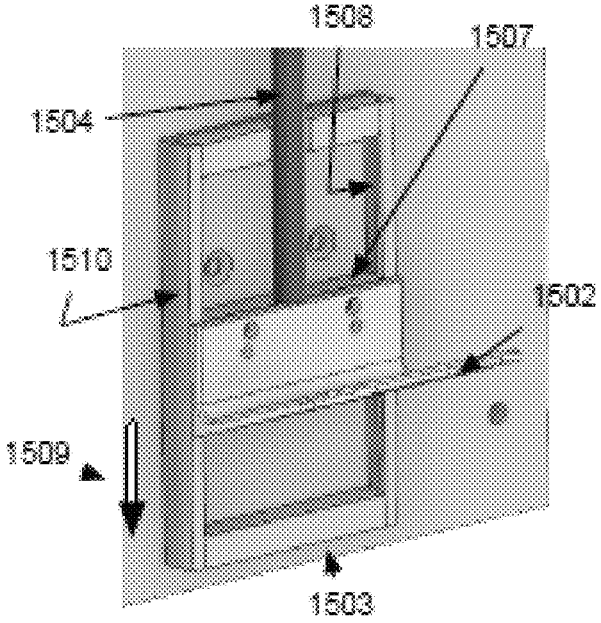
Figure 15A:
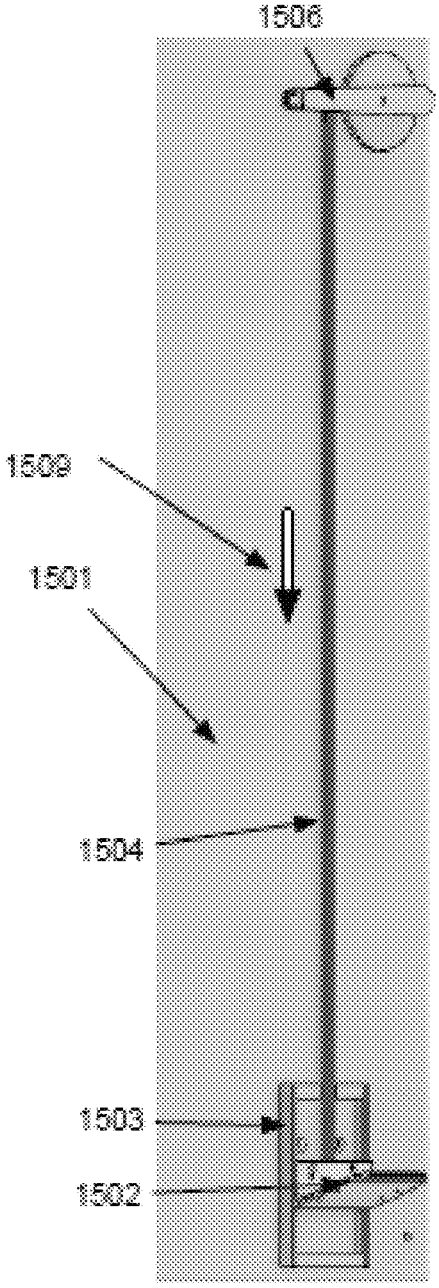
Figure 18:
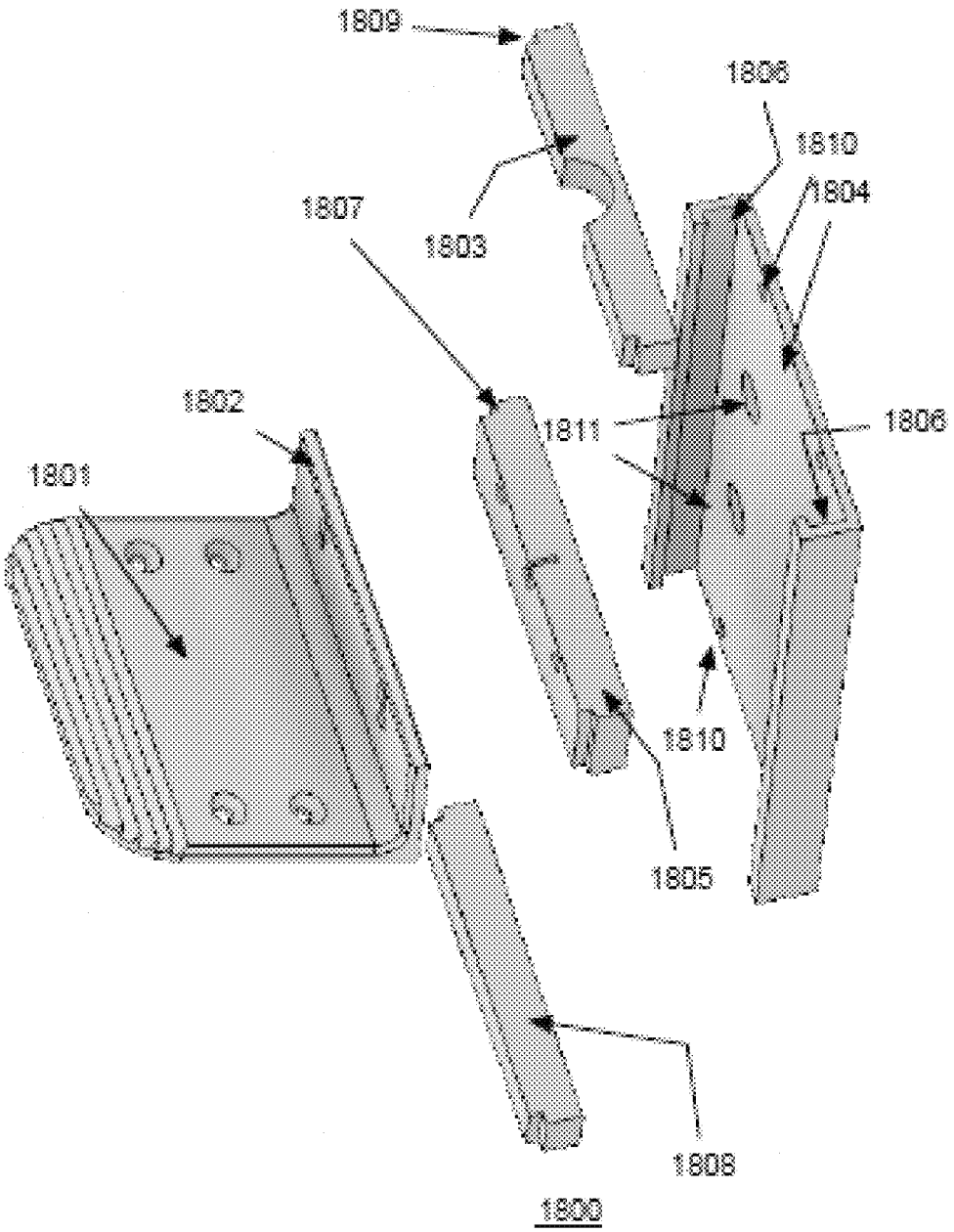
FIG. 18 shows details of components of the sliding foot pull.

FIGS. 15A-15C show an embodiment of using the foot pull 1502 with a sliding actuator 1503 that is attached in the usual position of the outside bottom surface of a door 1501. A rod 1504 is attached to the actuator sliding and clamping plate 1507, such that when the user presses downward 1509 upon the foot pull the rod also moves downward thereby pulling the door latch lever 1506 through actuation of the slotted bracket 1505. The rod 1504 attached to the slot on the slotted bracket. The sliding actuator, shown in more detail in FIG. 18, is seen here to include an outer housing 1510 that is rectangular and the inner surface of the two vertical walls of the housing includes grooves 1508. A sliding plate 1507 has edges that match the contour of the groove 1508 such that the sliding plate moves smoothly up and down when the foot pull 1502 is pressed downward or released. In one embodiment the door latch lever is spring loaded such that the handle moves into the latched position when pressure upon the foot pull is released thereby pulling the foot pull back into an upward position within the sliding actuator 1503. In another embodiment, shown in FIGS. 19 and 20, the sliding actuator further includes a spring located within the actuator and below the sliding plate, such that the spring is loaded when the foot pull is moved downward 1509 and the spring pushes upward upon the sliding plate and thereby raising the foot pull when downward pressure on the foot pull is released.

Figure 16B:
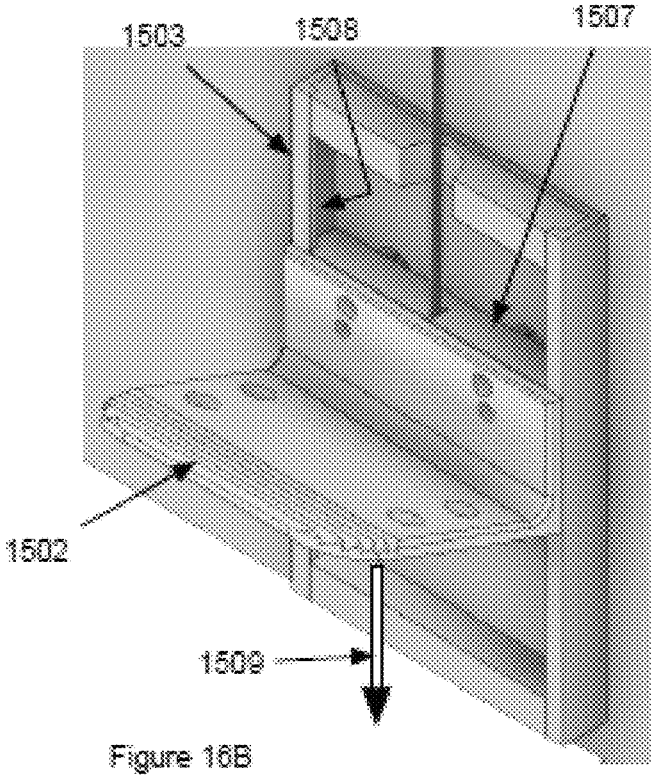
FIGS. 16A-16B show an embodiment of a foot pull including a sliding foot pull and a cable linkage.
Figure 16A:
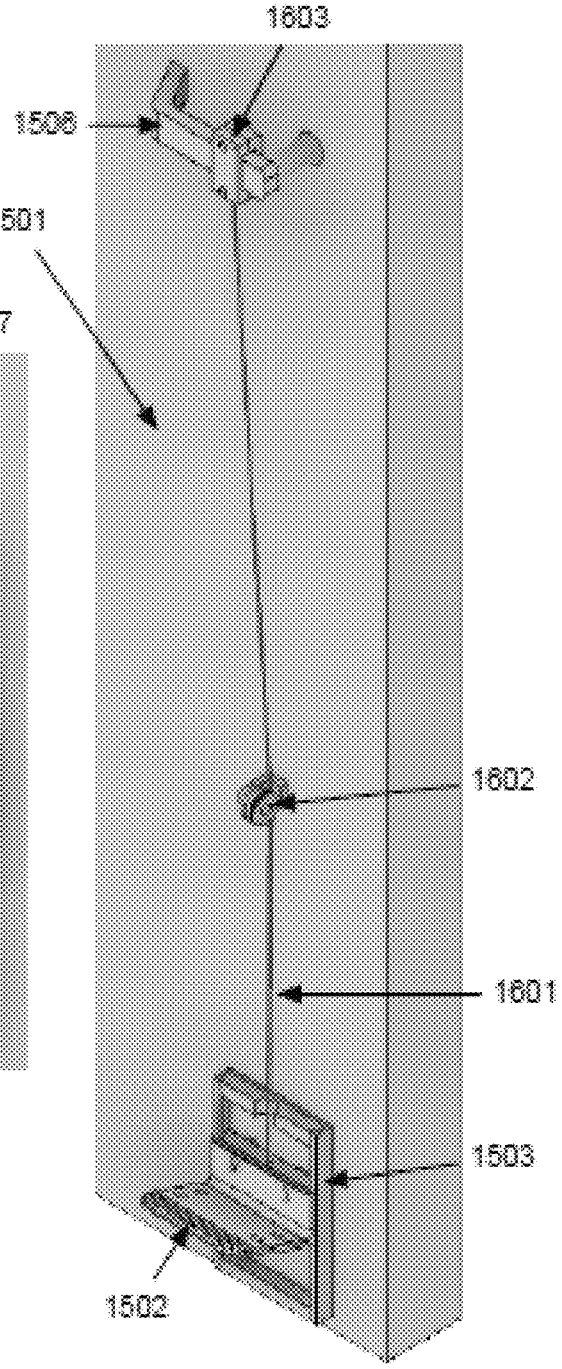
Figure 17D:
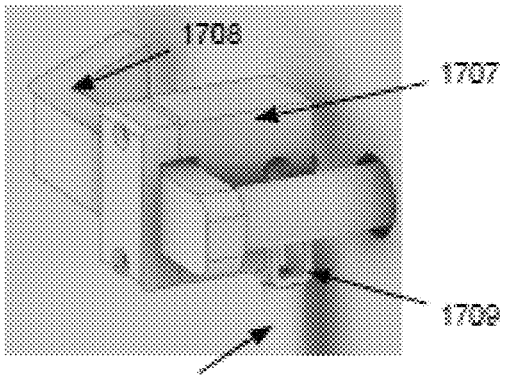
FIGS. 17A-17D show an embodiment of a foot pull including a sliding foot pull and a bar linkage with a pivot.
Figure 17C:
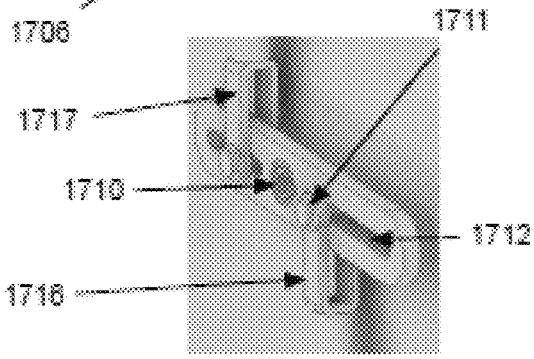
Figure 17B:
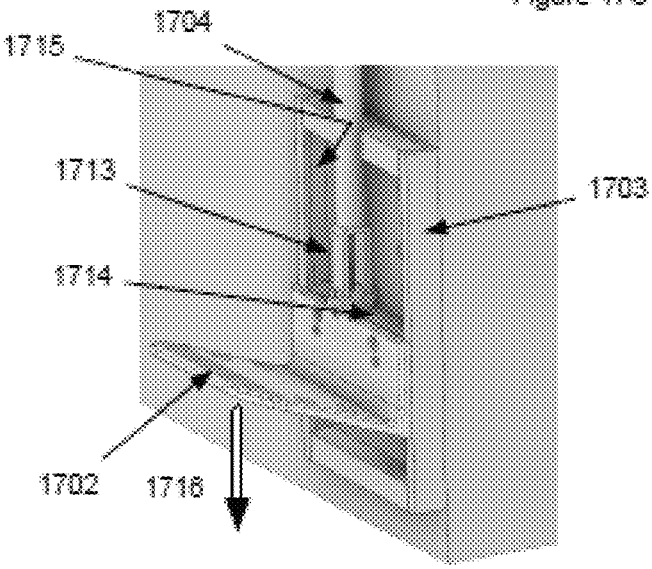
Figure 17A:
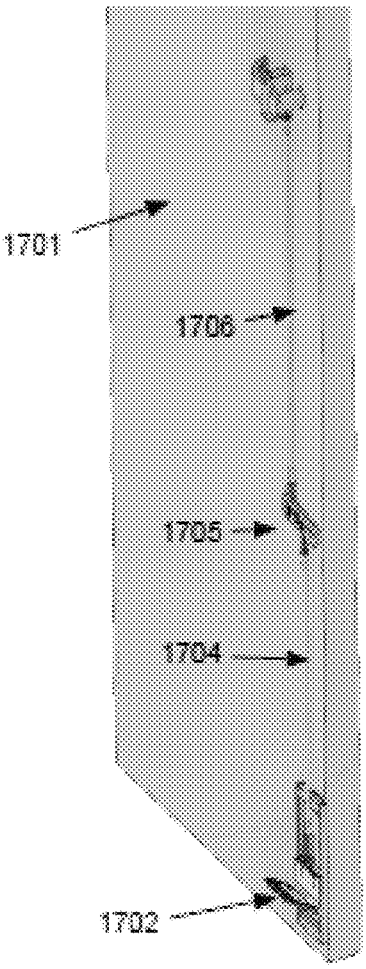

In another embodiment, shown in FIGS. 16A and 16B, the foot pull is used with the same sliding actuator as described in FIGS. 15A-15C except that the rod 1504 is replaced with a cable 1601 that is threaded through a guide 1602 to a bracket 1603 clamped to the door latch handle 1506 such that downward pressure on the foot pull 1502 causes the cable to pull down on the door latch handle thereby releasing the latch.

Another embodiment, shown in FIG. 17, uses the same sliding actuator 1703, but with a linkage 1704, 1705, 1706 that includes a pivot 1705 such that the downward 1716 motion of the foot pull 1702, results in an upward motion of the door handle 1706. The sliding actuator 1703 is attached as already described to a face of the door 1701. A foot pull engages the sliding actuator through use of a slide plate 1714 to which a U-connector 1713 is attached. A rod 1704 is attached to the U-connector. In one embodiment the U-connector 1714 is threaded and the end of the rod 1704 is also threaded such that the two parts may be screwed together and the effective length of the threaded rod 1704 can be adjusted. A similar connector 1716 is used at the opposite end of the rod 1704. The U-connector includes a pin 1711 fitted through the slot 1712 on a first arm of the pivot mechanism. The pivot mechanism includes a pivoting point 1710 and a second slot (not labeled) in a second arm (not labeled). This slot is also connected through a U-connector 1717 attached to a second rod 1706, connected through yet another U-connector 1709 to a clamp 1707 attached to the door latch lever 1708. Downward motion on the foot pull 1702 is transferred through the pivot 1705 to an upward motion on the second rod 1706 resulting in pushing the door latch lever in an upward direction.

Details of the slide actuator shown in FIGS. 15A-17B is shown in FIG. 18. The slide actuator 1800 includes a foot pull as used in all embodiments the foot pull has foot platform 1801 extending at an angle of 70° from the vertical plate 1802 in the preferred embodiment. The vertical plate is attached to a sliding block 1807 the ends 1807 of which are shaped to fit into the groove 1806 formed as a U on either vertical edge of the back plate 1804. A top block 1803 and a bottom block 1808, both with ends 1809 formed to match grooves 1806, are fixed in place at the top and bottom of the backplate 1804 using holes 1810. The back plate 1804 further includes holes 1811 for attachment of the back plate and entire sliding actuator 1800 to the door surface.

Figure 19C:
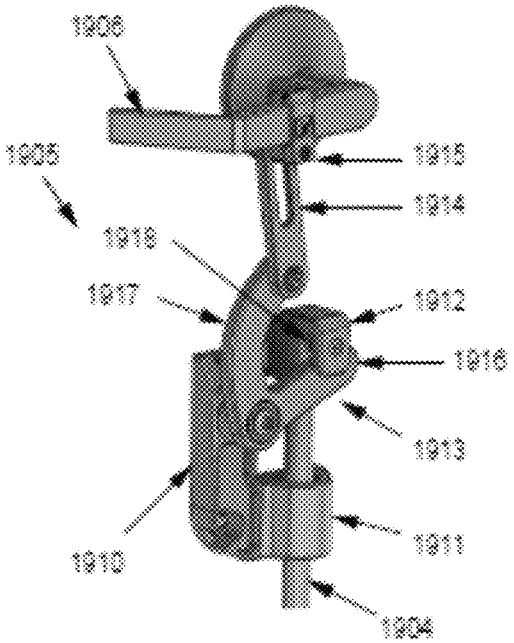
FIGS. 19A-19C show an embodiment of a foot pull including a spring-loaded foot pull and a linkage with a pivot.
Figure 19B:
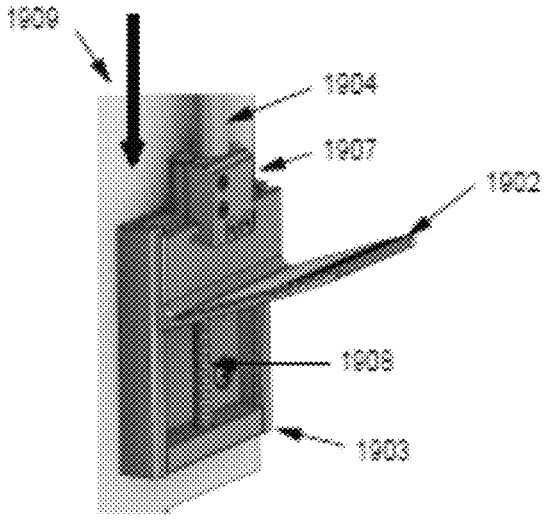
Figure 19A:
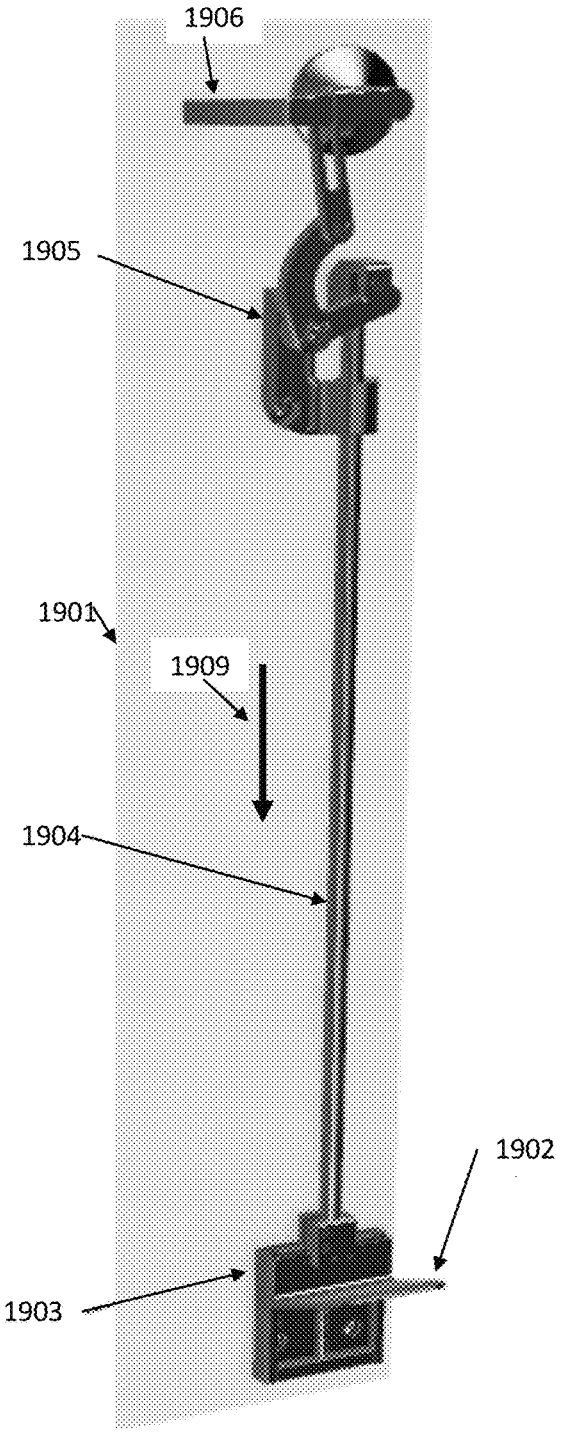
Figure 20:
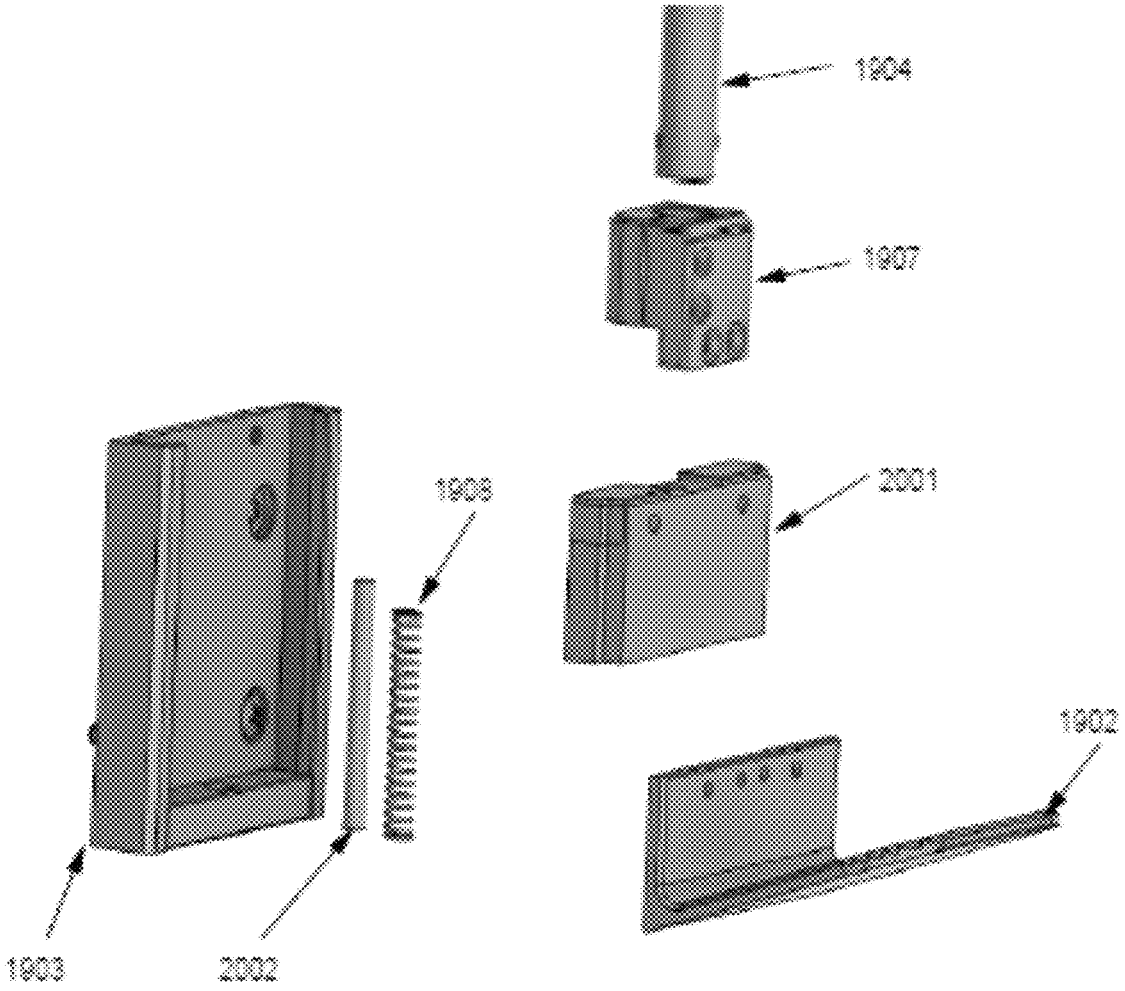
FIG. 20 shows an exploded view of the spring-loaded foot pull in FIG. 19B.

FIGS. 19A-19C show an embodiment using the foot pull 1902 with a sliding actuator housing 1903 that is attached in the usual position of the outside bottom surface of a door 1901. As in FIG. 18, a sliding and clamping plate 2001, shown in FIG. 20, slides within grooves formed into the vertical edges of housing 1903. A rod 1904 is attached to the actuator sliding and clamping plate 2001 using compression clamp 1907, such that when the user presses downward 1909 upon the foot pull 1902 the rod 1904 also moves downward thereby pulling down the door latch lever 1906 through actuation of the mechanical linkage 1905. Pressing downward 1909 on foot pull 1902 also compresses spring 1908 which returns the foot pull 1902 and sliding and clamping plate assembly 2001 to its upper position upon release of foot pressure on foot pull 1902, thereby allowing door latch lever 1906 to return to its nominal (latched) position. Spring 1908 is guided by rod 2002 also shown in FIG. 20 and received by holes drilled in housing 1903 and sliding and clamping plate 2001.

Figure 21:
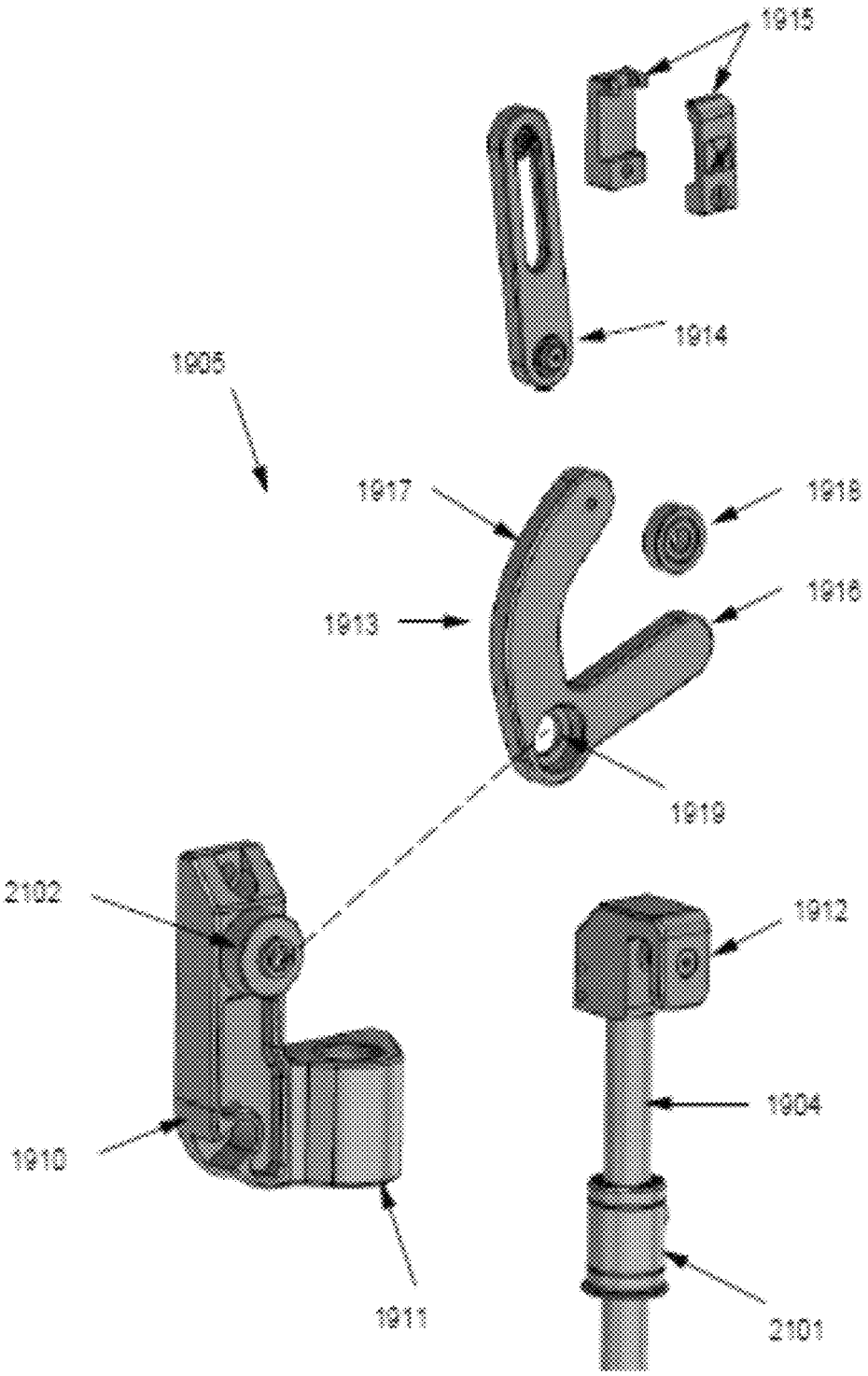
FIG. 21 shows an exploded view of the linkage with a pivot in FIG. 19C.

The rod 1904 engages the pivoted lever 1913 in the mechanical linkage 1905 through a slot in fitting 1912 attached to the end of the rod 1904. The pivot lever 1913 is approximately C-shaped with one straight arm 1916 and one curved arm 1917 each extending from the pivot 1919. As shown in FIG. 19C, the base 1910 of the mechanical linkage 1905 is rigidly attached to the door 1901 and includes clamp 1911 for the sliding bearing 2101 shown in FIG. 21 that guides rod 1904. Pivoted lever 1913 rotates about its pivot point 1919 on bearing 2102 also shown in FIG. 21 that is mounted to base 1910. The lower arm 1916 of pivoted lever 1913 engages slotted fitting 1912 that is attached to rod 1904 through the bearing 1918 that rides on the top surface of the lower arm 1916 and exerts a downward pressure when the rod is moved in a downward direction by actuation of the foot pull 1902. Upon release of the foot pull the rod and therefore the fitting 1912 move in an upward direction. The connection design allows the pivot lever arm 1916 to disengage from the bearing 1918 slotted fitting 1912 and the rod 1904 when the lever on the door is actuated using one's hands rather than through the foot pull. The upper arm of pivoted lever 1913 is longer than the lower arm and engages the lower end of slotted arm 1914 in a pivot. The longer upper arm provides an increase in the axial motion of the engagement of slotted arm 1914 relative to the motion of the rod 1904 and the pivot at the base of slotted arm 1914 ensures that the force applied to door latch lever 1906 is largely axial. Door latch lever 1906 is gripped by clamp 1915 which rides in the slot machined into slotted arm 1914. The slot in arm 1914 allows manual operation of the door lever without engaging the foot pull mechanism. Should the slot be too short to allow a full desired motion of the door lever, pushing further down on the door level will cause pivot 1913 to rotate and disengage bearing 1918 from lever arm 1916. The design allows for a retrofit of existing doors, thereby adding a foot actuator but at the same time maintaining the ability to actuate the door latch using one's hands and automatically disengage the foot actuator.

SUMMARY

An improved foot pull for hands free opening of a door is described. The design provides a more ergonomic engagement of the user by providing an angled plate to engage their foot the plate further including a region treated to prevent slippage of the users foot off of the plate. A pair of the foot pulls can be used in tandem to provide a door stop and a means to hold a door in the open position against a wall. The design can also include actuators that can release a latch on the door. The actuators can be electronic with wired or wireless connection to the latch on the door and can further be used to signal and actuate any electronic device such as a light or alarm system. The door pull can also include a mechanical cable or a hydraulic connection to actuate the door latch.

Those skilled in the art will appreciate that various adaptations and modifications of the preferred embodiments can be configured without departing from the scope and spirit of the invention. Therefore, it is to be understood that the invention may be practiced other than as specifically described herein, within the scope of the appended claims.

What is claimed is:

1. A foot pull for hands free opening or closing of a door, the foot pull comprising:

a) a first vertical rectangular plate (102) having a top edge and a bottom edge, and the first vertical rectangular plate configured for attaching the foot pull to the door, and, b) a second nearly horizontal rectangular plate (101) that is angled upward from horizontal, and, attached along a first edge to the bottom edge of the first vertical rectangular plate, and, c) a region (104) along a second edge of the nearly horizontal rectangular plate, the second edge opposite the first edge of the nearly horizontal rectangular plate, where the region is treated to improve traction of a user of the foot pull by either serration of the region (104) or application of a stair tread tape to the region or by application of sand filled paint to the region or by etching or sand blasting to roughen the region, and, d) where the user engages the foot pull by placing their foot atop the nearly horizontal plate in the region treated for improved traction and pulling on the foot pull by moving their foot such that the door moves in the same direction they move their foot thereby moving the door in either an opening or closing direction without using their hands, and, e) wherein the first vertical rectangular plate is attached to a sliding actuator (1503) that is attached to the door, wherein the sliding actuator comprises;

i. a rectangular outer housing affixed to the door having vertical and horizontal walls each with inner and outer surfaces, wherein the inner surfaces of the vertical walls of the housing are grooved, and, ii. a sliding plate that has vertical and horizontal edges wherein the shapes of the vertical edges match the grooves in the vertical walls of the outer housing and is mounted within the outer housing such that the sliding plate moves smoothly in a vertical direction and to which the foot pull is attached, and, iii. a first rigid bar having a first and second end, wherein the first end is attached to the top horizontal edge of the sliding plate such that the first rigid bar raises and lowers as the sliding plate is raised and lowered by the foot pull and the second end of the first rigid bar attaches to a linkage that engages a door latch, and, f) wherein the door latch is a conventional spring-loaded latch having an elongated handle and can be unlatched by applying an upward or downward force to said elongated handle, wherein the elongated handle is connected to the second end of the first rigid bar by a linkage, and the force transmitted by the first rigid bar is applied to rotate said elongated door latch handle to unlatch the door when the foot pull is engaged.

2. The foot pull of claim 1 wherein the linkage connecting the elongated latch handle to the first rigid bar comprises a slotted bracket attached to the latch handle within which a U-connector attached to the second end of the first rigid bar allows the force applied to the foot pull to be applied to effect downward rotation of the latch handle.

3. The foot pull of claim 1 wherein the linkage connecting the elongated latch handle to the first rigid bar comprises:

a) a narrow pivoted bracket mounted to the door and located between the foot pull and the door latch and having first and second ends each having a lateral slot located on either side of the pivot point, and, b) the second end of the first rigid bar of the foot pull is connected to the first end of the pivoted bracket by a U-connector inserted through the first lateral slot and attached to the second end of the first rigid bar, and, c) a second rigid bar having first and second ends has a first end connected to the second end of the pivoted bracket by a U-connector inserted through the second lateral slot and the second end of the second rigid bar attached to the elongated latch handle by a U-connector connected to the second end of the second rigid bar and inserted through a clamp attached to the elongated latch handle thereby allowing upward rotation of the latch handle when the foot pull is engaged.

4. The foot pull of claim 1 further comprising a compression spring mounted between the inner surface of the lower horizontal wall of the rectangular housing and the lower horizontal edge of the sliding plate, said spring guided on a rod inserted in a hole formed in the inner surface of the lower horizontal wall of the rectangular housing and sliding vertically through a hole formed in the sliding plate.

5. The foot pull of claim 4, wherein the door latch is a conventional spring-loaded latch having an elongated door latch handle and can be unlatched by applying a downward force to said elongated handle, wherein the elongated handle is connected to the second end of the first rigid bar by a linkage, and the force transmitted by the first rigid bar of the foot pull is applied to rotate said elongated door latch handle to unlatch the door when the foot pull is engaged, and, the linkage is disengaged from the foot pull when the downward force is removed.

6. The foot pull of claim 5 wherein the linkage connecting the elongated latch handle to the rigid bar comprises:

a) a linkage base attached to the door below the elongated latch handle including a sliding guide for the first rigid bar, and, b) a pivoted J-shaped lever attached to the linkage base having a first straight arm that engages a slotted clamp through a roller bearing in the slotted clamp, the roller bearing engaging a top edge of the straight arm, the slotted clamp attached to the second end of the first rigid bar and the pivoted J-shaped lever having a second, longer curved arm whose end is rotatably attached to a slotted arm that engages the elongated latch handle, and, c) a pivoted bracket that clamps to the elongated latch handle and rides in the slot in the slotted arm thereby applying downward rotation of the elongated latch handle when the foot pull is engaged.

* * * * *